US007942702B2

(12) United States Patent
Chang

(10) Patent No.: US 7,942,702 B2
(45) Date of Patent: May 17, 2011

(54) MODULAR CONNECTOR

(76) Inventor: Nai-Chien Chang, Sanchong (TW)

( * ) Notice: Subject to any disclaimer, the term of this patent is extended or adjusted under 35 U.S.C. 154(b) by 0 days.

(21) Appl. No.: 12/770,836

(22) Filed: Apr. 30, 2010

(65) Prior Publication Data

US 2011/0028043 A1 Feb. 3, 2011

(30) Foreign Application Priority Data

Jul. 29, 2009 (TW) ..... 98213923 U

(51) Int. Cl.
*H01R 33/92* (2006.01)

(52) U.S. Cl. ..... 439/638; 439/541.5

(58) Field of Classification Search ..... 439/79, 439/540.1, 541.5, 638
See application file for complete search history.

(56) References Cited

U.S. PATENT DOCUMENTS 5,217,394 A * 6/1993 Ho ..... 439/620.21
6,206,724 B1 * 3/2001 Leung ..... 439/540.1
6,964,585 B2 * 11/2005 Blichasz et al. ..... 439/638
7,632,139 B2 * 12/2009 Chou et al. ..... 439/541.5

* cited by examiner

*Primary Examiner* — Khiem Nguyen
(74) *Attorney, Agent, or Firm* — Chun-Ming Shih; HDLS IPR Services

(57) ABSTRACT

A modular connector includes a base and at least one adaptor. The base is provided with at least one first assembling port. The first assembling port has an insertion slot therein. The insertion slot has a plurality of insertion holes. Each of the plurality of insertion holes is provided with an electrical-conductive pin extending outside the base. The adaptor has a rear end with an insertion pin and a front end with a connecting port. The connecting port has a tongue therein. The tongue is provided with a plurality of electrical-conductive terminals. One end of each of the electrical-conductive terminals is electrically connected with the insertion pin. The adaptor is assembled in the first assembling port. The insertion pin is inserted into and electrically connected to the insertion slot.

9 Claims, 12 Drawing Sheets

MODULAR CONNECTOR

BACKGROUND OF THE INVENTION

1. Field of the Invention

The present invention relates to a connector, and in particular to a connector which can be assembled quickly with different transmission interfaces based on the demands of clients.

2. Description of Prior Art

With the continuous advancement of science and technology and the demands for practice use, various kinds of new-generation connectors are developed, such as a stack-up connector or a multi-port connector with the combination of USB and HDMI, USB and DisplayPort, or USB and e-SATA. With this arrangement, the layout of different I/O transmission interfaces can be simplified with less space.

Although the stack-up connector or multi-port connector really simplifies the layout of different I/O transmission interfaces, such a connector is unchangeable in term of specification after it is manufactured. If a client needs another kind of stack-up connector or multi-port connector, such as the connector having the combination of USB, HDMI and DisplayPort or the combination of HDMI and DisplayPort, the manufacturer has to design another mold for this demand. After this new connector is manufactured, however, if the number of users or sales volume is not large enough, the production cost of the connector will be shared by the insufficient users, so that the price is inevitably higher for the users.

SUMMARY OF THE INVENTION

In order to solve the problems in prior art, the present invention is to provide a modular connector, whereby the manufacturer can quickly assemble different standards of transmission interfaces in one connector based on the demands of clients.

The present invention provides a modular connector, including:

a base provided with at least one first assembling port, the first assembling port having an insertion slot therein, the insertion slot having a plurality of insertion holes, each of the plurality of insertion holes being provided with an electrical-conductive pin extending outside the base; and at least one adaptor, the adaptor having a rear end with an insertion pin and a front end with a connecting port, the connecting port having a tongue therein, the tongue being provided with a plurality of electrical-conductive terminals, one end of each of the electrical-conductive terminals being electrically connected with the insertion pin, the adaptor being assembled in the first assembling port, the insertion pin being inserted into and electrically connected to the insertion slot.

The present invention further provides a modular connector, including:

a base having at least one first assembling port, a distal end of the first assembling port having a circuit board, the circuit board being electrically connected to an insertion slot thereon, the insertion slot having a plurality of insertion holes, a distal end of the circuit board having an insertion terminal extending outside the base; and at least one adaptor, the adaptor having a rear end with an insertion pin and a front end with a connecting port, the connecting port having a tongue therein, the tongue being provided with a plurality of electrical-conductive terminals, one end of each of the electrical-conductive terminals being electrically connected with the insertion pin, the adaptor being assembled in the first assembling port, the insertion pin being inserted into and electrically connected to the insertion slot.

DETAILED DESCRIPTION OF THE INVENTION

The detailed description and technical contents of the present invention will be explained with reference to the accompanying drawings. However, it should be understood that the drawings are illustrative only, but not used to limit the present invention.

Figure 1:
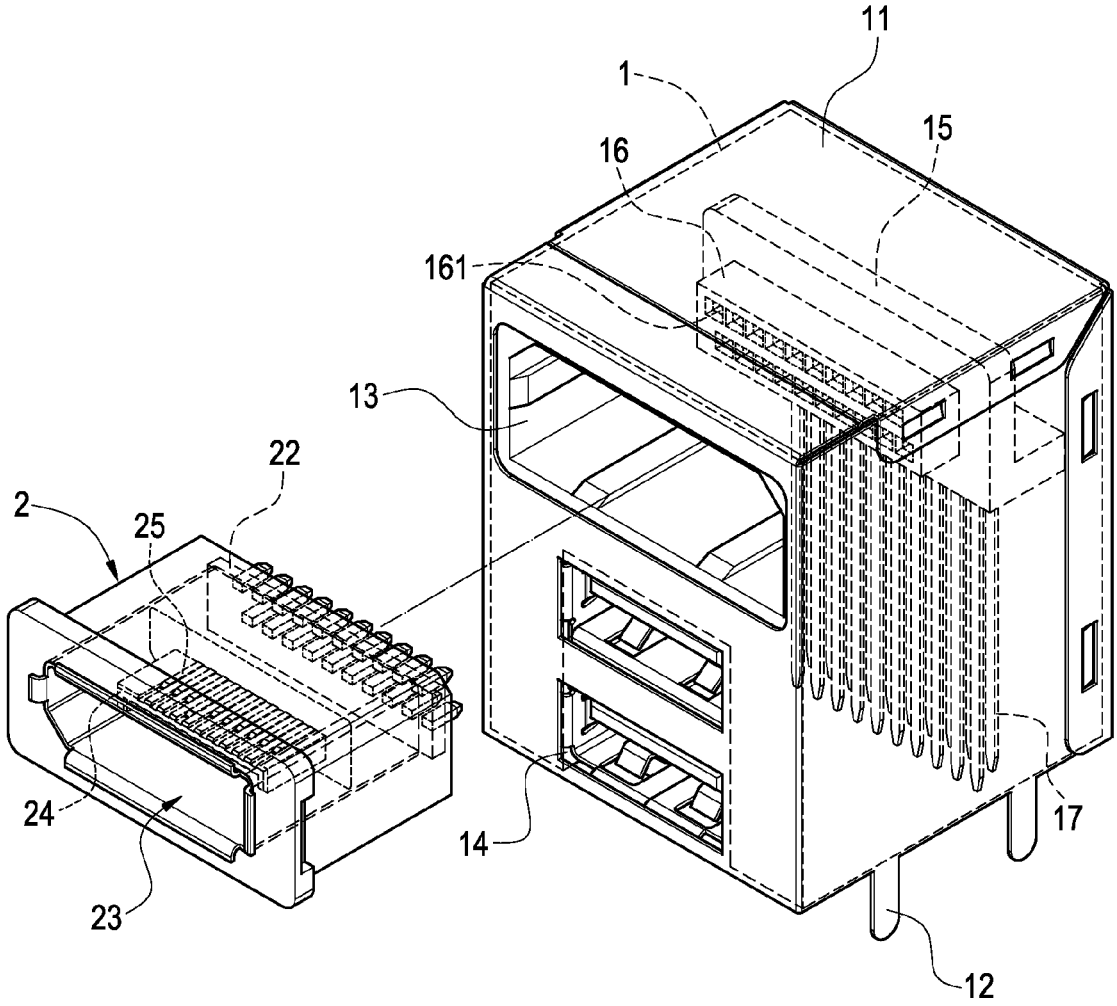
FIG. 1 is an exploded perspective view showing a connector of the present invention.

Please refer to FIG. 1, which is an exploded perspective view showing the connector of the present invention. The connector of the present invention includes a base 1 and an adaptor 2.

The upper surface of the base 1 is covered by a metallic casing 11. The underside of the metallic casing 11 extends to form a fixing leg 12. The base 1 is provided with a first assembling port 13 and two second assembling ports 14. The interior of the first assembling port 13 has an L-shaped fixing plate 15. The fixing plate 15 has an insertion slot 16. The insertion slot 16 has a plurality of insertion holes 161. Electrical-conductive pins 17 are electrically connected between the insertion holes 161 and the fixing plate 15. The other end of each of the electrical-conductive terminals 17 extends to the outside of the base 1, thereby electrically connecting to a circuit board of another electronic device (not shown). Further, like the first assembling port 13, the second assembling port 14 can be assembled with a connector having the standard of any one of HDMI, DisplayPort, USB, and e-SATA.

The adaptor 2 is assembled in the first assembling port 13. The front end of the adaptor 2 has a baffle 21 and its rear end has an insertion pin 22. The adaptor 2 has a connecting port 23. The interior of the connecting port 23 has a tongue 24. The tongue 24 is provided with a plurality of electrical-conductive terminals 25. One end of each of the electrical-conductive terminals 25 is electrically connected to the insertion pin 22. When the adaptor 2 is inserted into the first assembling port 13, the insertion pin 22 is inserted into the insertion hole 161 of the insertion slot 16, so that the insertion pin 22 can be electrically connected to the insertion slot 16. In the drawings, the connecting port 23 of the adaptor 2 is configured to have the standard of any one of HDMI, DisplayPort, USB, and e-SATA, so that a transmission line or device having a HDMI, DisplayPort or USB type transmission interface can be inserted into the connecting port 23.

Figure 2:
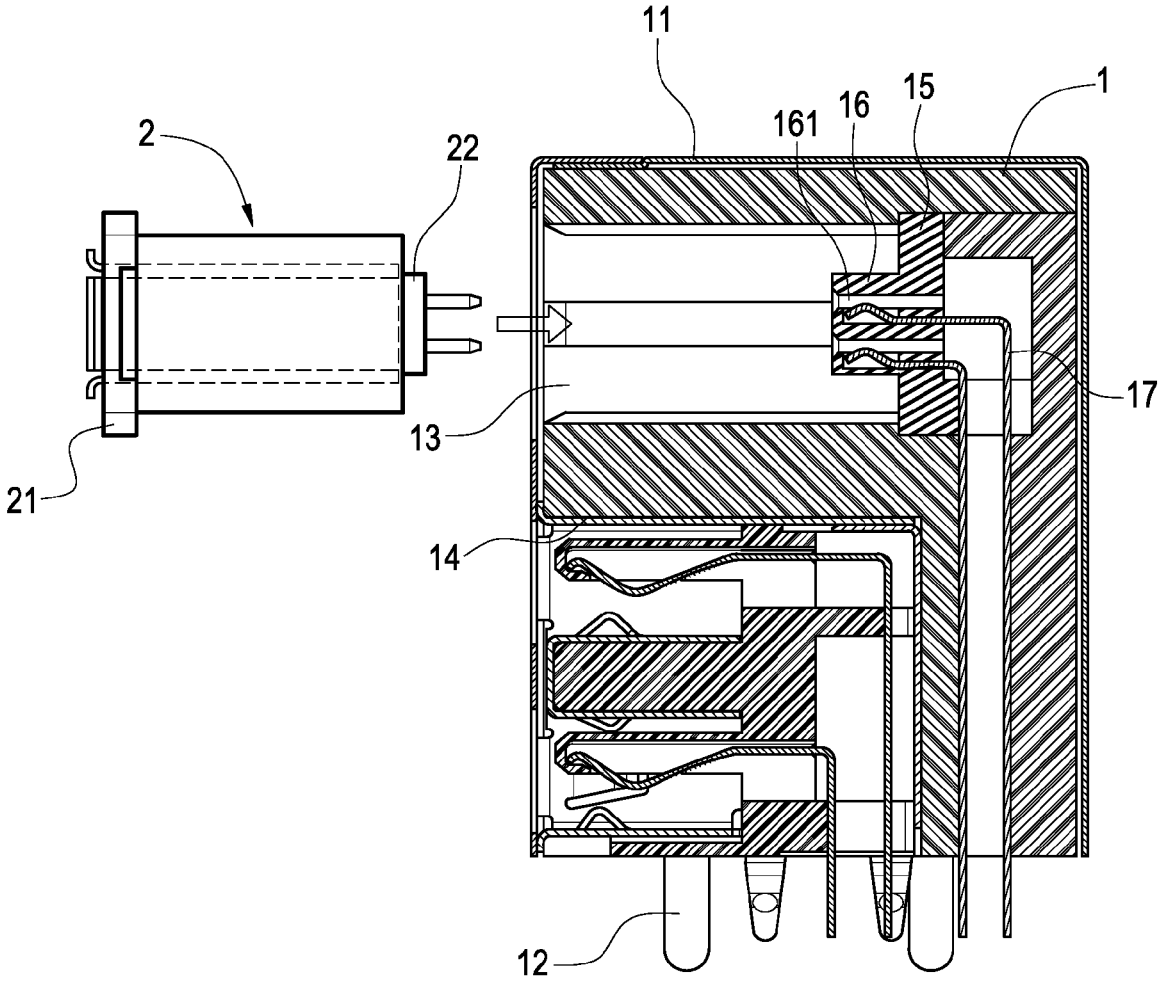
FIG. 2 is a side cross-sectional view showing the assembly of the connector of the present invention.
Figure 3:
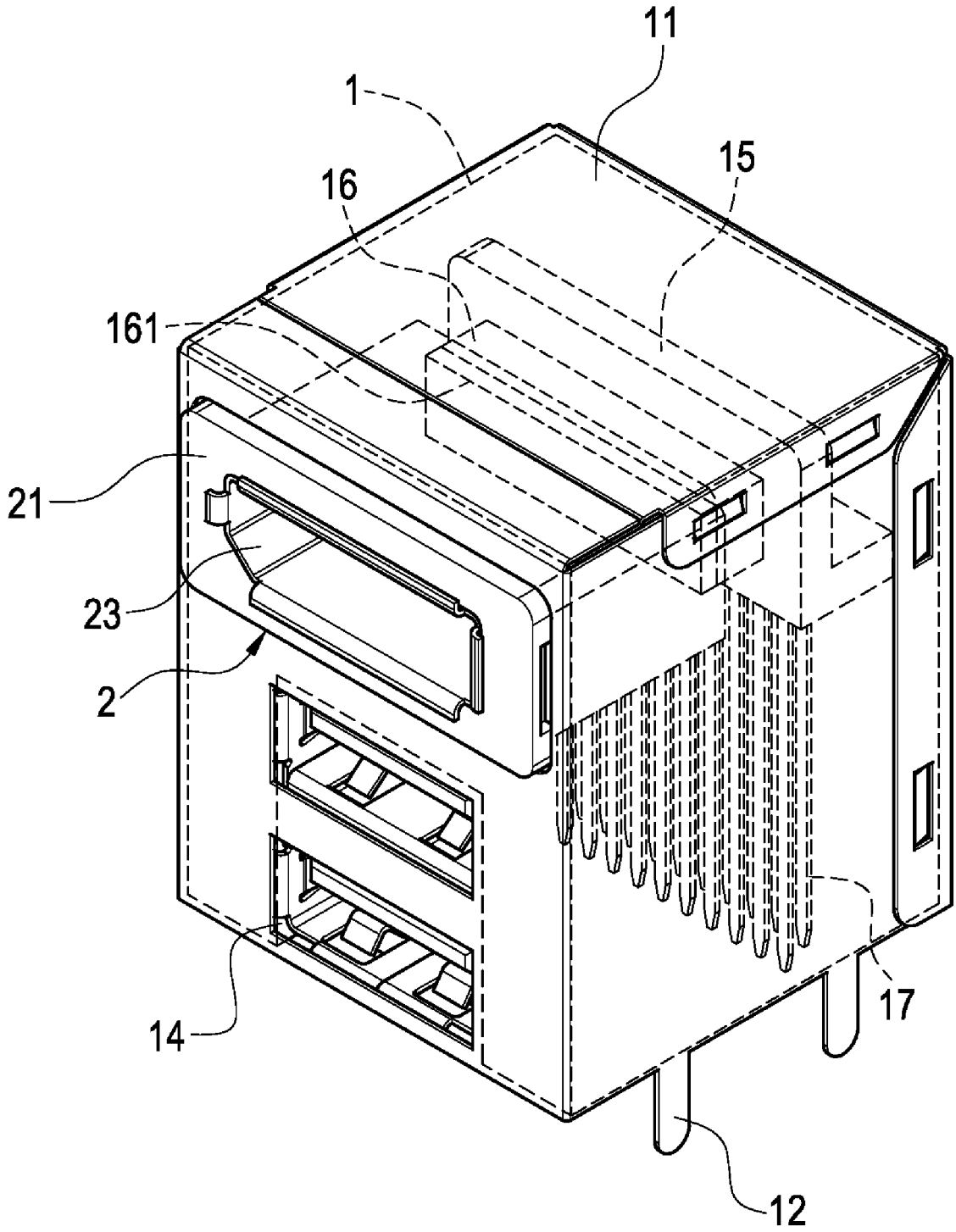
FIG. 3 is a schematic view showing the complete assembly of the connector of the present invention.

Please refer to FIGS. 2 and 3. FIG. 2 is a side cross-sectional view showing the assembly of the connector of the present invention, and FIG. 3 is a schematic view showing the complete assembly of the connector of the present invention. The connector of the present invention can be customized based on the demands of clients. If the client requires a stack-up connector having the combination of DisplayPort and USB, the manufacturer can assemble the adaptor 2 having the standard of DisplayPort into the first assembling port 13 and pushed the adaptor 12 further therein. In this way, the insertion pin 22 is inserted into the insertion hole 16 of the insertion slot 16, thereby achieving the electrical connection between the adaptor 2 and the base 1.

After the DisplayPort type adaptor 2 is assembled into the base 1, not only a transmission line or device having a USB type transmission interface can be inserted into the base 1, but also a transmission line having the standard of DisplayPort can be inserted into the adaptor 2.

Figure 4:
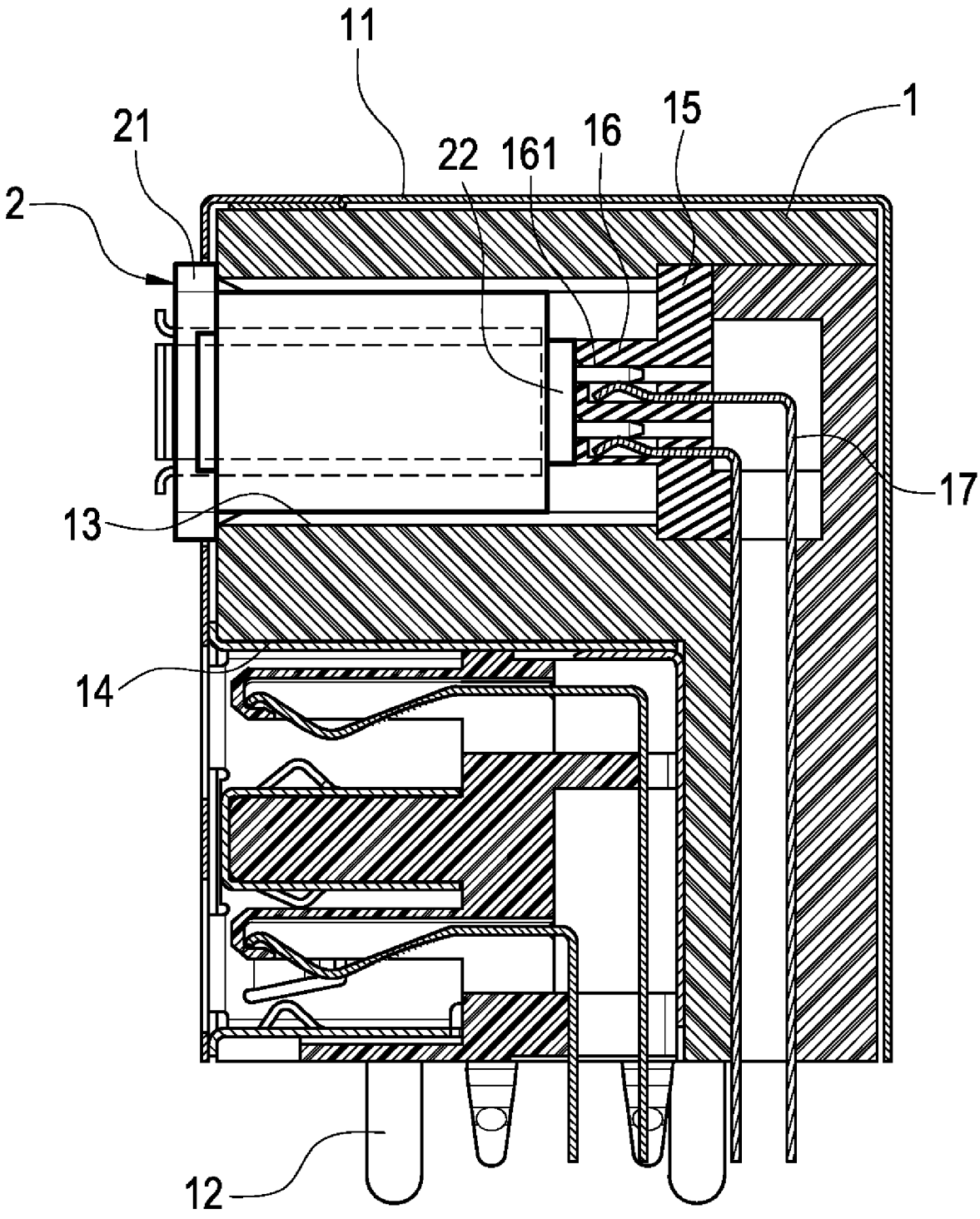
FIG. 4 is a side cross-sectional view showing the connector of the present invention.
Figure 5:
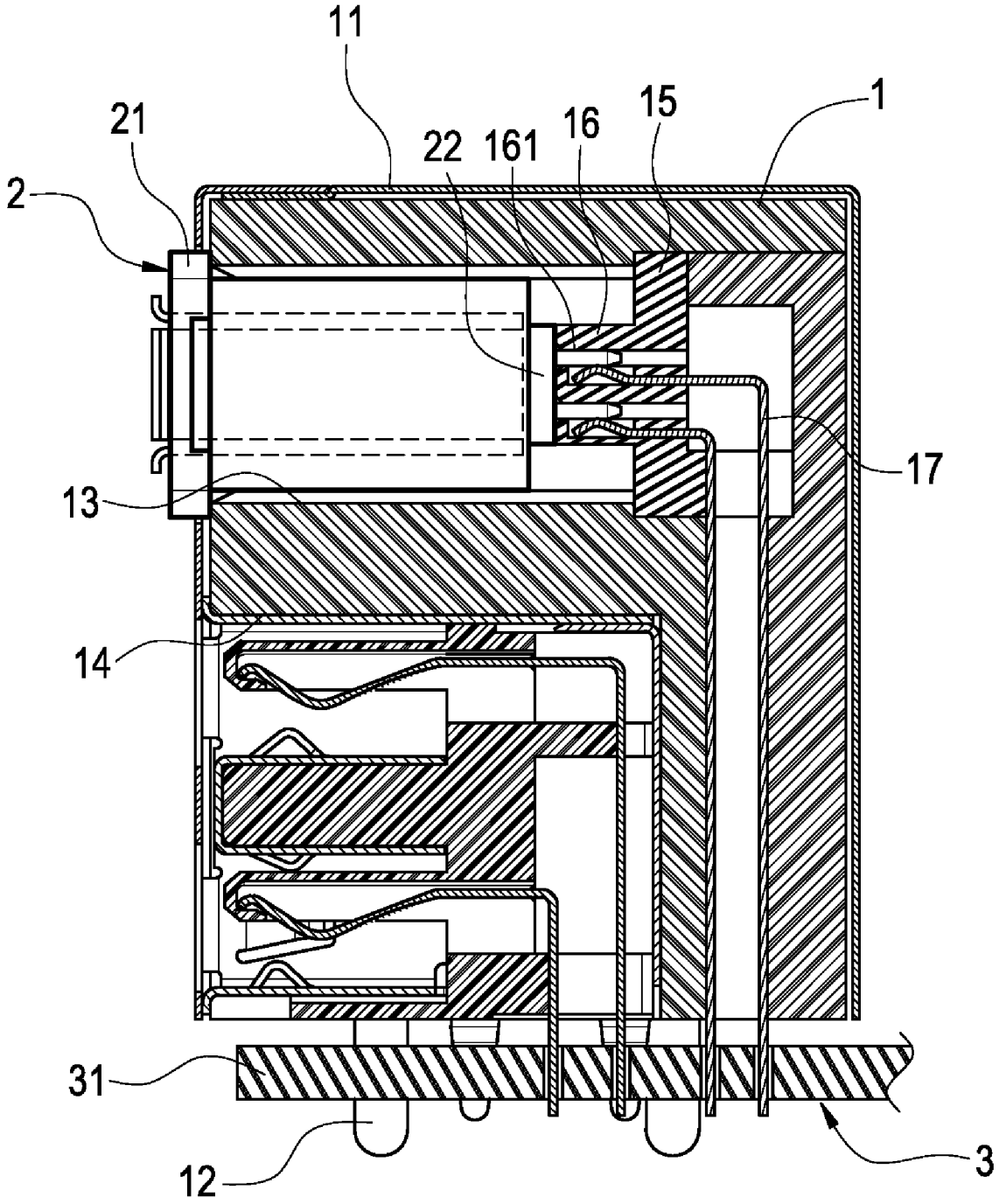
FIG. 5 is a schematic view showing the electrical connection between the connector of the present invention and an electronic device.

FIG. 4 is a side cross-sectional view showing the connector of the present invention, and FIG. 5 is a schematic view showing the electrical connection between the connector of the present invention and an electronic device. As shown in these figures, after the DisplayPort type adaptor 2 is assembled into the base 1, the electrical-conductive pins 17 extending outside the base 1 can be electrically connected to a mother board 31 of an electronic device 3. At the same time, the fixing leg 12 under the metallic casing 11 of the base 1 is fixedly connected to the mother board 31 of an electronic device 3. After the connector is electrically connected to the mother board 31, the adaptor 2 allows a DisplayPort type transmission line to be inserted therein for signal transmission.

Figure 6:
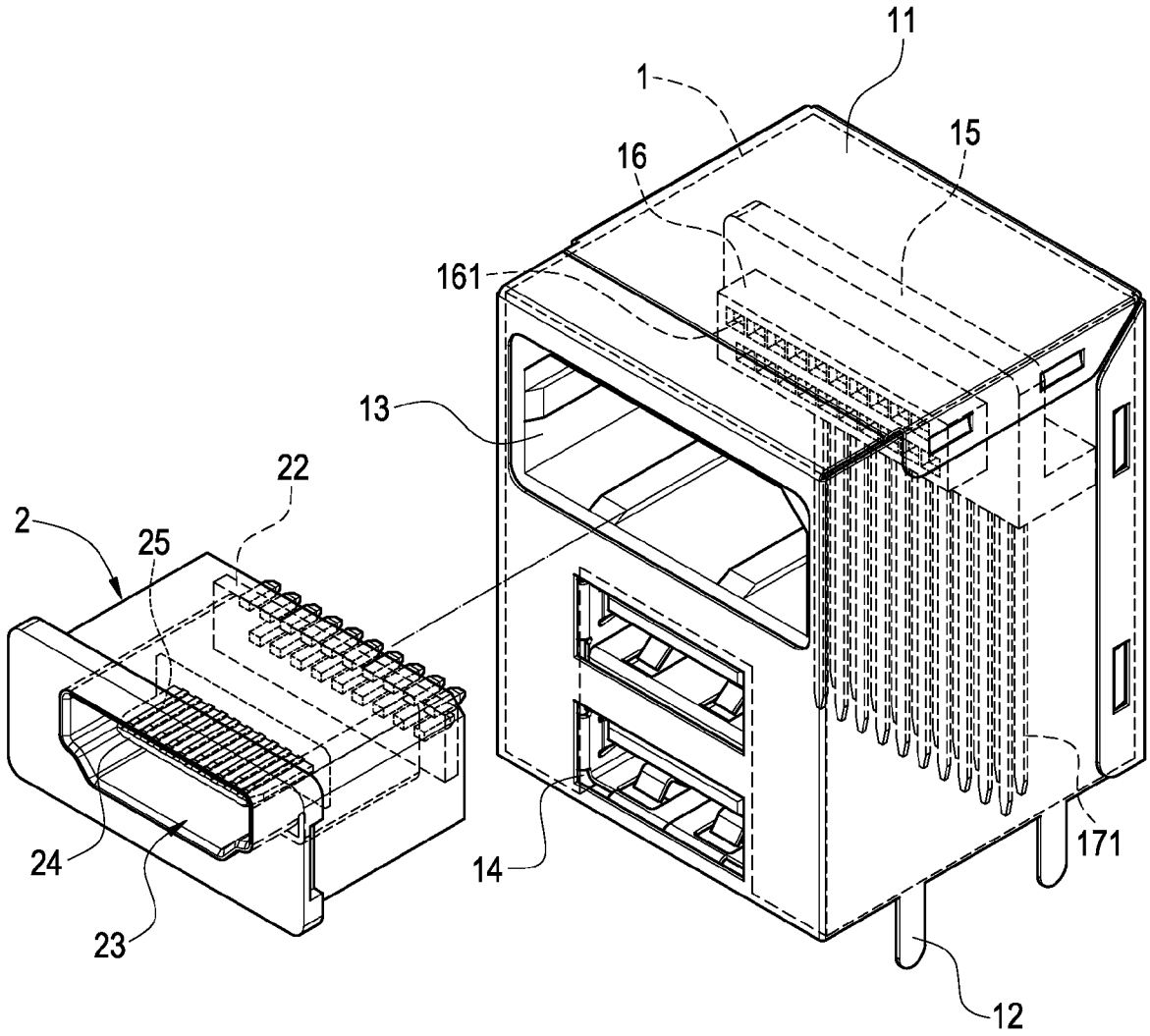
FIG. 6 is a schematic view showing a second embodiment of the present invention.

Please refer to FIG. 6, which shows the second embodiment of the present invention. As shown in this figure, when the connecting port 23 of the adaptor 2 has the standard of HDMI and is assembled into the base 1, such a HDMI type adaptor 2 allows a HDMI type transmission line to be inserted therein for signal transmission.

Figure 7:
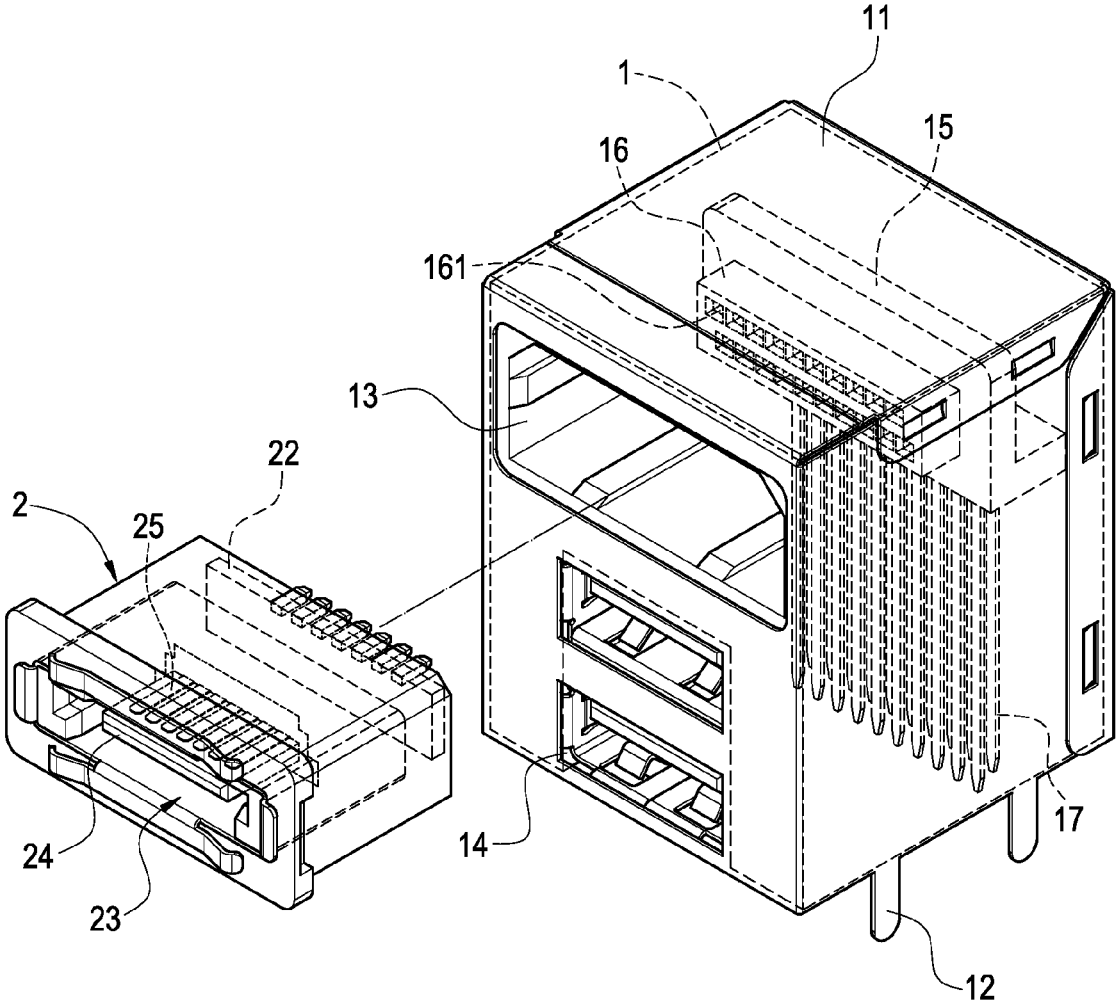
FIG. 7 is a schematic view showing a third embodiment of the present invention.

Please refer to FIG. 7, which shows the third embodiment of the present invention. As shown in this figure, when the connecting port 23 of the adaptor 2 has the standard of e-SATA and is assembled into the base 1, such an e-SATA type adaptor 2 allows an e-SATA type transmission line to be inserted therein for signal transmission.

Figure 8:
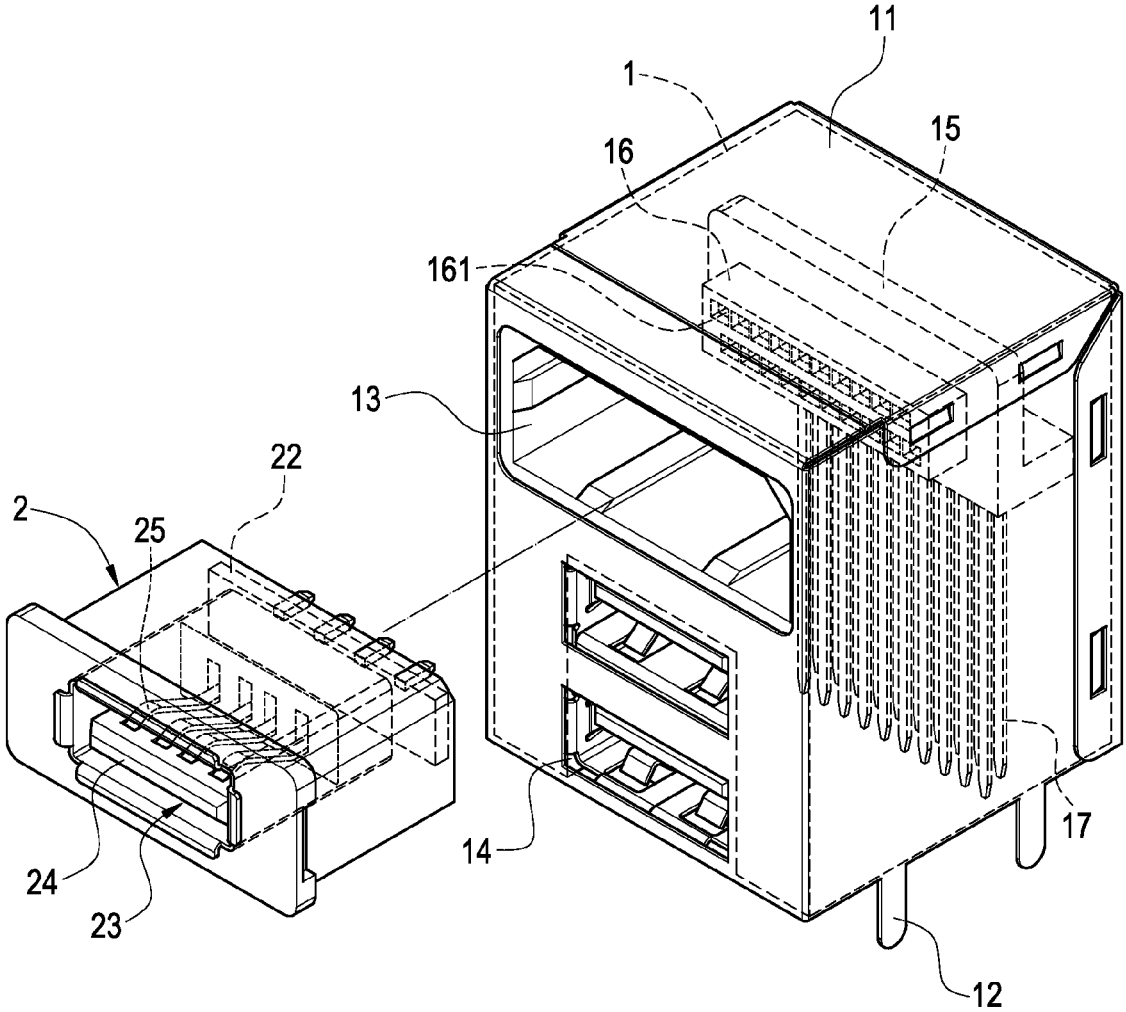
FIG. 8 is a schematic view showing a fourth embodiment of the present invention.

Please refer to FIG. 8, which shows the fourth embodiment of the present invention. As shown in this figure, when the connecting port 23 of the adaptor 2 has the standard of USB and is assembled into the base 1, such a USB type adaptor 2 allows a USB type transmission line to be inserted therein for signal transmission.

Figure 9:
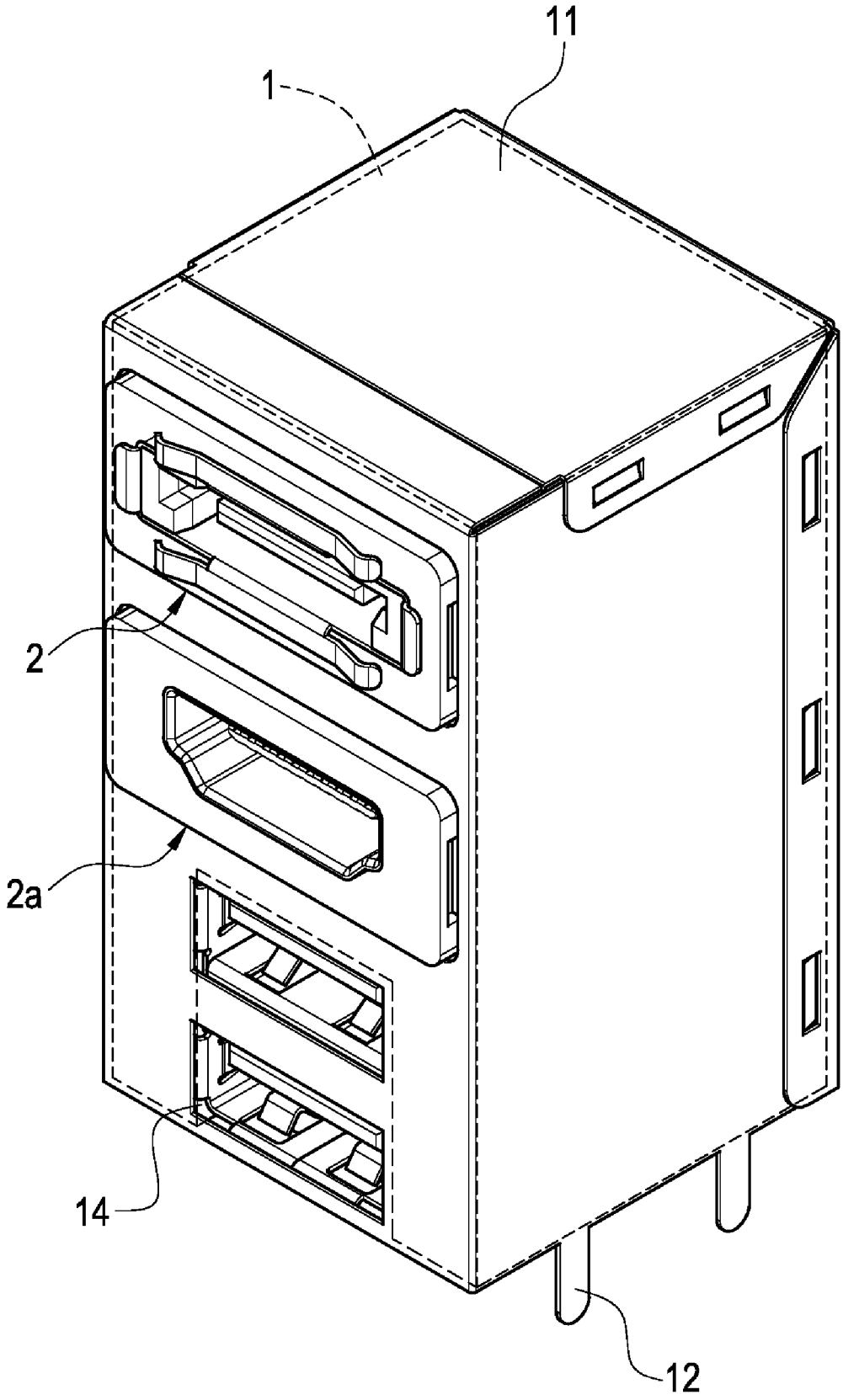
FIG. 9 is a schematic view showing a fifth embodiment of the present invention.

Please refer to FIG. 9, which shows the fifth embodiment of the present invention. As shown in this figure, two adaptor 2 and 2*a* are provided, in which two connecting ports thereof have the standards of any two of HDMI, DisplayPort, USB, and e-SATA. After the two adaptors 2 and 2*a* are assembled into the base 1, the adaptors 2 and 2*a* allows two transmission lines having different transmission interfaces selected from any two of HDMI, DisplayPort, USB and e-SATA to be inserted therein respectively for signal transmission.

Figure 10:
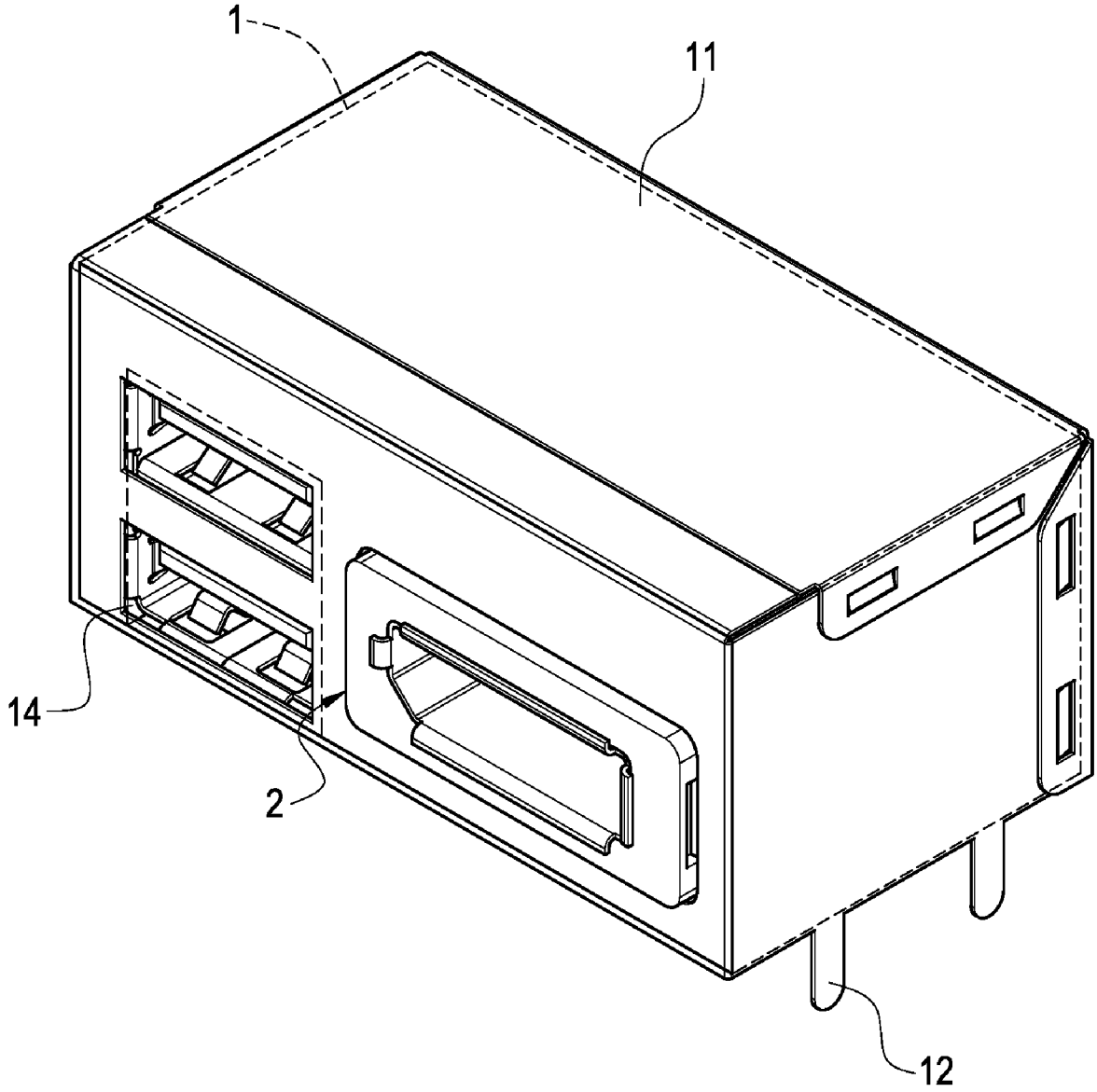
FIG. 10 is a schematic view showing a sixth embodiment of the present invention.

Please refer to FIG. 10, which shows the sixth embodiment of the present invention. As shown in this figure, in addition to a stack-up configuration, the adaptor 2 and the second assembling port 14 can be juxtaposed in the connector.

Figure 11:
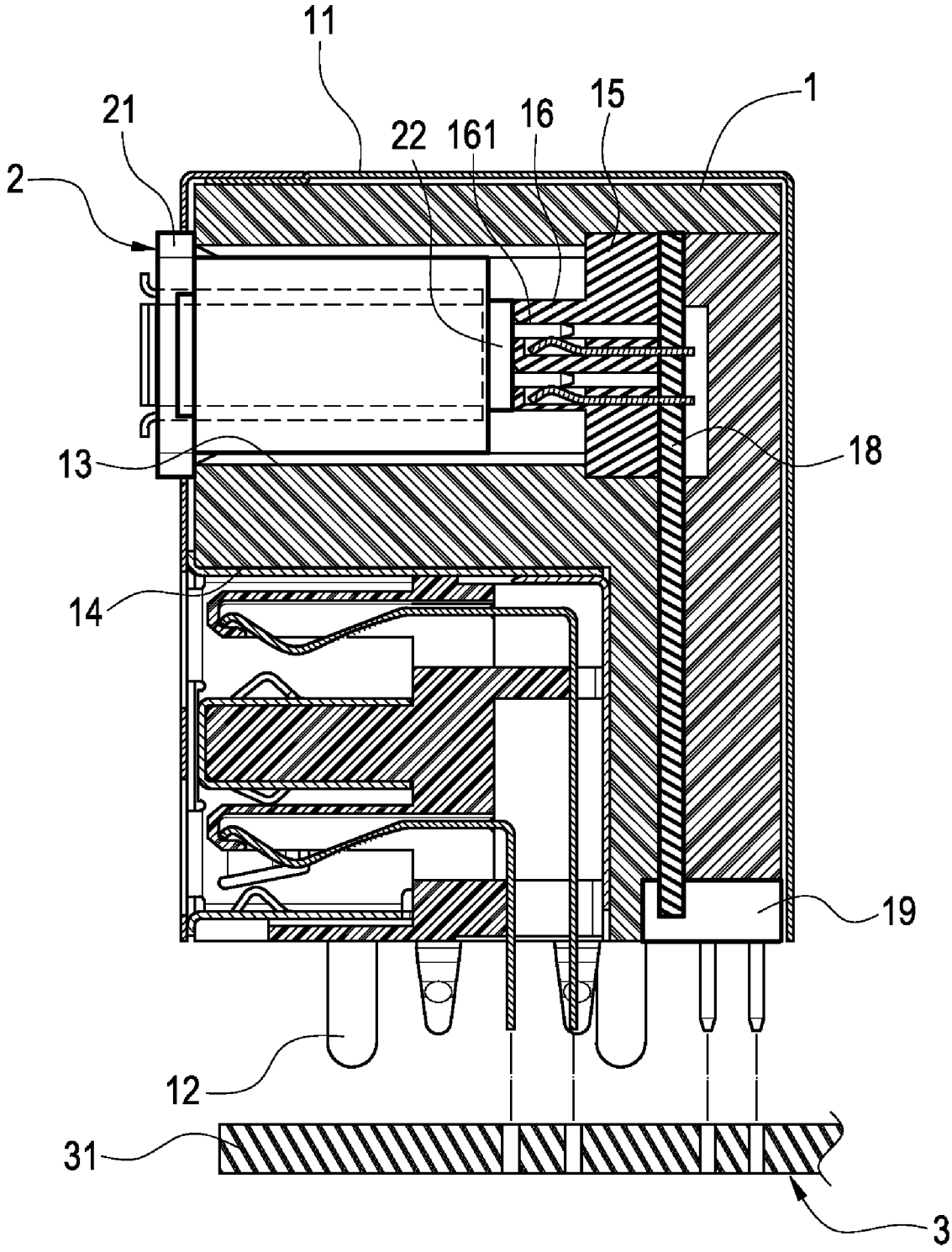
FIG. 11 is a schematic view showing a seventh embodiment of the present invention.
Figure 12:
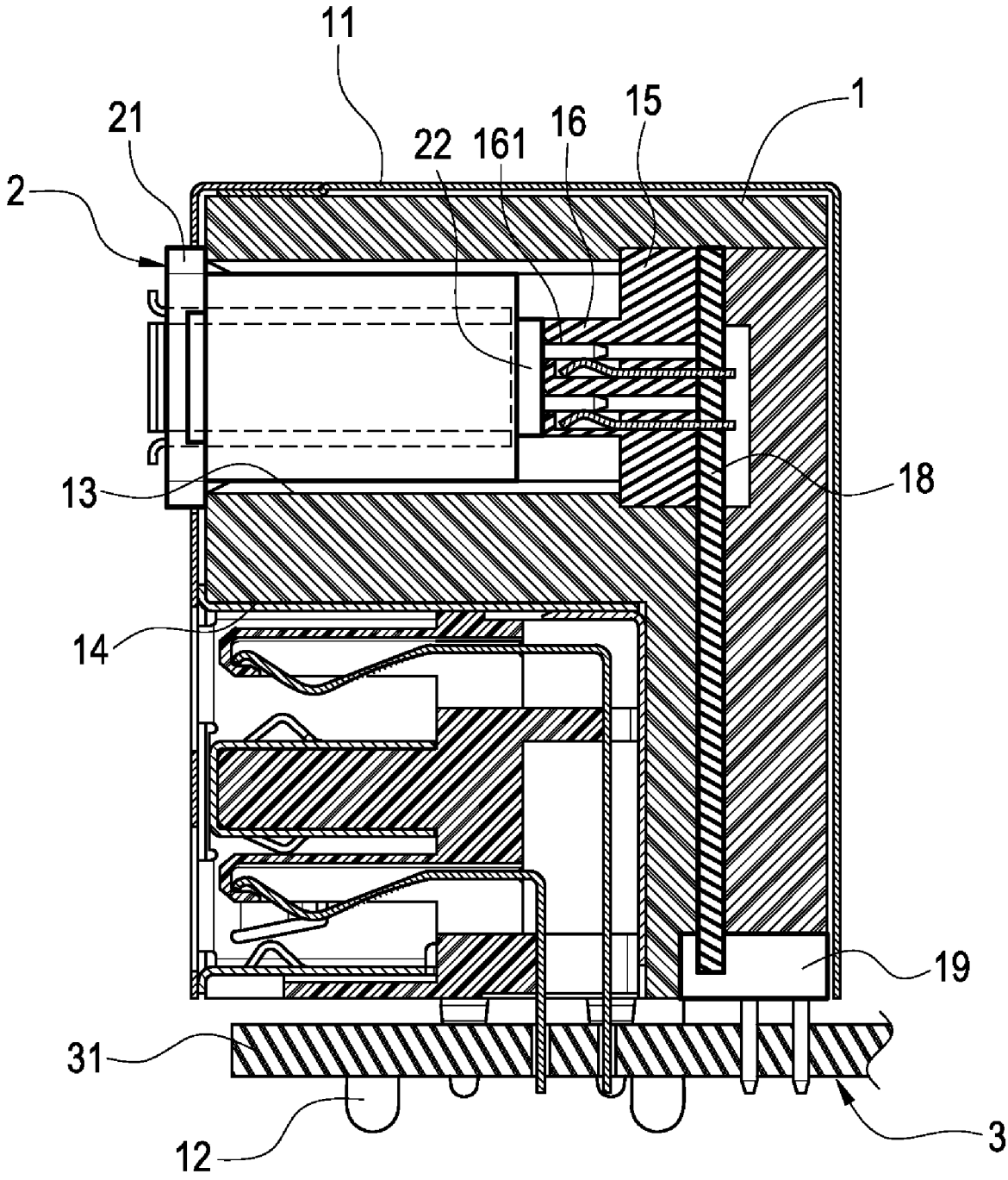
FIG. 12 is a schematic view showing the complete assembly of the seventh embodiment of the present invention.

Please refer to FIGS. 11 and 12. FIG. 11 is a schematic view of the seventh embodiment of the present invention, and FIG. 12 is a schematic view showing the complete assembly of the present invention. As shown in these figures, the seventh embodiment is substantially the same as those shown in FIGS. 1 to 5 except that the insertion slot 16 within the first assembling port 13 is electrically connected to the circuit board 18. The distal end of the circuit board 18 is electrically connected to an insertion terminal 19. The insertion terminal 19 extends outside the base 1 to be electrically connected to the mother board 31 of the electronic device 3.

Although the present invention has been described with reference to the foregoing preferred embodiments, it will be understood that the invention is not limited to the details thereof Various equivalent variations and modifications can still occur to those skilled in this art in view of the teachings of the present invention. Thus, all such variations and equivalent modifications are also embraced within the scope of the invention as defined in the appended claims.

What is claimed is:

1. A modular connector, configured to be electrically connected to a mother board of an electronic device and comprising:

a base provided with at least one first assembling port, the first assembling port having an insertion slot therein, the insertion slot having a plurality of insertion holes, each of the plurality of insertion holes being provided with an electrical-conductive pin extending outside the base; and at least one adaptor, the adaptor having a rear end with an insertion pin and a front end with a connecting port, the connecting port having a tongue therein, the tongue being provided with a plurality of electrical-conductive terminals, one end of each of the electrical-conductive terminals being electrically connected with the insertion pin, the adaptor being assembled in the first assembling port, the insertion pin being inserted into and electrically connected to the insertion slot.

2. The modular connector according to claim 1, wherein the first assembling port has a fixing plate therein for fixing the insertion slot and allowing the electrical-conductive pins to pass through.

3. The modular connector according to claim 1, wherein the front end of the adaptor is provided with a baffle through which the connecting port is exposed.

4. The modular connector according to claim 3, wherein the connecting port of the adaptor has the standard of any one of HDMI, DisplayPort, USB and e-SATA.

5. The modular connector according to claim 1, wherein the base further comprises a second assembling port for allowing a connector having the standard of any one of HDMI, DisplayPort, USB and e-SATA to be mounted therein.

6. A modular connector, configured to be electrically connected to a mother board of an electronic device and comprising:

a base having at least one first assembling port, a distal end of the first assembling port having a circuit board, the circuit board being electrically connected to an insertion slot thereon, the insertion slot having a plurality of insertion holes, a distal end of the circuit board having an insertion terminal extending outside the base; and at least one adaptor, the adaptor having a rear end with an insertion pin and a front end with a connecting port, the connecting port having a tongue therein, the tongue being provided with a plurality of electrical-conductive terminals, one end of each of the electrical-conductive terminals being electrically connected with the insertion pin, the adaptor being assembled in the first assembling port, the insertion pin being inserted into and electrically connected to the insertion slot.

7. The modular connector according to claim 6, wherein the front end of the adaptor is provided with a baffle through which the connecting port is exposed.

8. The modular connector according to claim 7, wherein the connecting port of the adaptor has the standard of any one of HDMI, DisplayPort, USB and e-SATA.

9. The modular connector according to claim 6, wherein the base further comprises a second assembling port for allowing a connector having the standard of any one of HDMI, DisplayPort, USB and e-SATA to be mounted therein.

* * * * *